US010265231B2

(12) United States Patent
O'Reagan

(10) Patent No.: US 10,265,231 B2
(45) Date of Patent: Apr. 23, 2019

(54) SELF-POWERED MICROCLIMATE CONTROLLED MATTRESS

(71) Applicant: Span-America Medical Systems, Inc., Greenville, SC (US)

(72) Inventor: James R. O'Reagan, Greer, SC (US)

(73) Assignee: Span-America Medical Systems, Inc., Greenville, SC (US)

( * ) Notice: Subject to any disclaimer, the term of this patent is extended or adjusted under 35 U.S.C. 154(b) by 0 days.

(21) Appl. No.: 15/719,709

(22) Filed: Sep. 29, 2017

(65) Prior Publication Data

US 2018/0078436 A1 Mar. 22, 2018

Related U.S. Application Data

(60) Division of application No. 15/602,705, filed on May 23, 2017, which is a continuation of application No. 14/633,206, filed on Feb. 27, 2015, now Pat. No. 9,717,638.

(60) Provisional application No. 61/950,389, filed on Mar. 10, 2014.

(51) Int. Cl.
*A61G 7/057* (2006.01)

(52) U.S. Cl.
CPC ..... *A61G 7/05738* (2013.01); *A61G 7/057* (2013.01); *A61G 7/05769* (2013.01); *A61G 7/05784* (2016.11); *A61G 7/05715* (2013.01)

(58) Field of Classification Search
CPC ..... A61G 7/05738; A61G 7/05784; A61G 7/057; A61G 7/05769; A61G 7/05715; A61G 2007/05784; A61G 7/05792; B60V 3/025
See application file for complete search history.

(56) References Cited

U.S. PATENT DOCUMENTS

| | | | |
|---|---|---|---|
| 4,279,044 | A | 7/1981 | Douglas |
| 4,347,633 | A | 9/1982 | Gammons et al. |
| 4,631,767 | A | 12/1986 | Carr et al. |
| 4,862,538 | A | 9/1989 | Spann et al. |
| 5,025,519 | A | 6/1991 | Spann et al. |
| 5,168,589 | A | 12/1992 | Stroh et al. |
| 5,252,278 | A | 10/1993 | Spann et al. |
| D355,488 | S | 2/1995 | Hargest et al. |
| 5,493,742 | A | 2/1996 | Klearman |
| 5,509,155 | A | 4/1996 | Zigarac et al. |
| 5,568,660 | A | 10/1996 | Raburn et al. |

(Continued)

*Primary Examiner* — Nicholas F Polito
*Assistant Examiner* — Amanda L Bailey
(74) *Attorney, Agent, or Firm* — Dority & Manning, P.A.

(57) ABSTRACT

Disclosed are apparatus and methodology for reducing humidity (i.e., moisture) and/or heat within and/or adjacent a patient support mattress, without requiring any electrical power. A spacer fabric is used to create a non-crushable area of support below a patient's core area, where moisture and heat more commonly buildup. Integrated air cells in the mattress have resilient elements such as open-celled foam interiors. The air cells are connected by air tubing to the spacer fabric, and the mattress is otherwise vented externally from the spacer fabric. As a result, the patient's movement causes air to be expelled from or drawn into the air cells, which in turn results in air movement in the spacer fabric below a patient or user, resulting in cooling effects by removing moisture and/or heat, all without requiring external or internal electrical power.

24 Claims, 9 Drawing Sheets

(56) References Cited

U.S. PATENT DOCUMENTS 5,580,504 A 12/1996 Spann et al.
5,797,155 A 8/1998 Maier et al.
5,926,884 A 7/1999 Biggie et al.
5,970,550 A 10/1999 Gazes
6,164,092 A * 12/2000 Menaker ..... A47G 9/0246 5/497
6,223,369 B1 * 5/2001 Maier ..... A61G 7/05707 5/706
6,694,556 B2 2/2004 Stolpmann
6,730,115 B1 5/2004 Heaton
6,782,574 B2 8/2004 Totton et al.
6,855,158 B2 2/2005 Stolpmann
6,859,967 B2 3/2005 Harrison et al.
8,901,334 B2 12/2014 Lafleche et al.
9,717,638 B2 8/2017 O'Reagan
2002/0129448 A1 9/2002 Pirzada
2004/0040068 A1 * 3/2004 Silver ..... A41D 1/08 2/227
2006/0080778 A1 * 4/2006 Chambers ..... A47C 21/044 5/652.2
2007/0151033 A1 * 7/2007 Wyatt ..... A61G 7/05715 5/713
2007/0226911 A1 * 10/2007 Gladney ..... A47C 27/148 5/691
2008/0155755 A1 7/2008 Crousore et al.
2008/0263776 A1 10/2008 O'Reagan et al.
2008/0299854 A1 * 12/2008 Hilleary ..... A41D 31/0027 442/136
2010/0175196 A1 * 7/2010 Lafleche ..... A61G 7/05715 5/707
2011/0024348 A1 2/2011 Meyer-Blumenroth et al.
2012/0227186 A1 9/2012 Pile
2014/0035342 A1 * 2/2014 Scholz ..... A47C 7/24 297/452.48
2014/0109319 A1 4/2014 Wilkinson

* cited by examiner

SELF-POWERED MICROCLIMATE CONTROLLED MATTRESS

PRIORITY CLAIM

This application is a divisional of U.S. patent application Ser. No. 15/602,705 filed May 23, 2017 entitled "SELF-POWERED MICROCLIMATE CONTROLLED MATTRESS", which is a continuation of U.S. patent application Ser. No. 14/633,206 filed Feb. 27, 2015, now U.S. Pat. No. 9,717,638 issued Aug. 1, 2017, which claimed benefit of U.S. Provisional Patent Application Ser. No. 61/950,389 filed Mar. 10, 2014, all entitled "SELF-POWERED MICROCLIMATE CONTROLLED MATTRESS", and all of which are incorporated herein by reference for all purposes.

FIELD OF THE DISCLOSURE

This subject matter generally relates to mattresses and patient supports for preventing, reducing, and/or treating decubitus ulcers, also known as pressure sores or bedsores, and/or for improved comfort of consumer users. More particularly, the presently disclosed subject matter concerns mattresses or patient supports capable of reducing deleterious moisture and/or temperature levels related to support of a medical patient or consumer user.

BACKGROUND OF THE DISCLOSURE

Often, patients that are bedridden or immobile can develop decubitus ulcers (pressure sores, bedsores, or pressure injuries). Such ulcers are often caused by pressure, friction, shear forces, moisture, and/or heat. Pressure results in a reduction of blood flow to the soft tissues of the body, particularly the skin. Continuous lack of blood flow, and the resultant lack of oxygen, can cause the skin to die or atrophy, and cause ulcers or sores to form. Friction and shear of the skin against the support surface can lead to skin tears and decubitus ulcers. Moisture and heat may lead to skin maceration. Other factors play a part in determining the speed with which such ulcers will either tend to form or heal, including such as the overall health of the patient and such patient's nutritional status.

From a consumer user perspective (i.e., not necessarily involving long periods of bed rest beyond normal nighttime sleeping), moisture and heat buildup and other factors can create discomfort for the user.

To insure normal (or, at least, relatively improved) blood flow to such areas of potentially problematic contact, patients are often regularly turned or repositioned by medical personnel. Turning or repositioning of patients, however, is not always possible, particularly where trained medical staff is not available, or whenever other aspects of a patient's condition limit their ability to be moved. Additionally, even when physically feasible and appropriate personnel are present, repositioning can be painful and disruptive for the patient.

In an effort to overcome such difficulties, a number of mattresses and related devices (such as mattress coverlets or toppers) have been developed with the intention of more evenly distributing, across the patient's skin, the pressure generated by the weight of the body. Some such devices make use of static supports such as foam, air or water mattresses, while others involve the use of alternating pressure inflatable features in order to dynamically shift the location of support under the patient. Two examples of support surfaces are illustrated in U.S. Pat. Nos. 5,509,155 and 5,926,884.

In addition to such approaches to efforts for redistribution of skin pressure, an additional feature has been utilized to help address other of the aforementioned factors important to the healing and/or prevention process. In particular, a low air loss feature has been used to aid in the removal of both moisture vapor and heat, thereby reducing both at the patient-bed boundary. Such features are done in an effort to prevent skin maceration, keep wounds dry, and promote healing. In a consumer user context, the features result in improved comfort during sleep or rest.

Various approaches have been practiced for achieving a low air loss support surface. For example, in some instances, relatively tiny holes can be provided in the top surface of inflatable air cells of an air mattress having a vapor-permeable top surface, to allow extra air to circulate inside the mattress to assist in drying moisture vapor otherwise passing through the top surface from the patient. In other exemplary configurations, relatively tiny holes can be provided in the top surface of the mattress so that air vented from air cells can transfer through the top surface to the patient in order to remove both heat and moisture from the area immediately surrounding the patient.

Per still further exemplary approaches, in some instances a multi-layer mattress coverlet can be used wherein the top layer is perforated to allow air flowing between the top layer and a middle vapor-permeable layer to exhaust across the patient, thus aiding in removing both moisture and heat from the area immediately surrounding the patient. For some such devices, one of the layers of such a multi-layer approach may be a three-dimensional fabric, which allows for additional moisture vapor to be carried away from the patient.

While each of these approaches is useful for its purpose, there are various disadvantages with these approaches and in particular, with using them individually. Some of the referenced approaches to obtaining a low air loss feature require a relatively large compressor pump or the like to maintain sufficient air to inflate the air cells of the mattress. Such large compressor pumps tend to be very noisy, require high electrical consumption, and themselves can generate significant heat in a relatively confined area. Such high electrical consumption, and the additional need for continuous blower operation, has, in the past, resulted in potential over-heating of the air used to circulate about the patient. Conversely, in the case of an elderly patient, airflow directly across their body could result in an uncomfortable reduction in body temperature or even a drying out of the skin beyond that which is helpful.

Additionally, having holes in air cells of an inflatable air system results in a support surface that will deflate if there is a loss of electrical power or if no such power supply is available. Further, having perforations in the patient-bed contact surface results in a mattress that is not fluid-proof. Such arrangement allows for potential contamination of the interior of such mattress by bodily fluids, products used to treat the patient, and/or products used to clean such mattress itself. Some exemplary approaches generally fail in some respects to allow air to flow under load (i.e., underneath the patient) or through the top surface to the patient's skin when supporting the weight of the patient.

Similarly, some prior art mattresses and mattress coverlets have had difficulty with billowing, which is generally an uncontrolled inflation of the upper surface of a mattress or mattress coverlet in the area immediately surrounding the outline of a patient's body when the patient lies on the mattress. In essence, the mattress or mattress coverlet fails to fully support a patient and instead seemingly envelops them when the patient's weight is applied thereto. Thus, such billowing further illustrates the failure of some prior mattresses and/or mattress coverlets to fully support the patient, therefore resulting in air flow through the mattress, mattress top layer, or through the coverlet and around the patient, rather than flowing underneath the patient to aid in controlling moisture and heat.

Various aspects of the prior art are described in the following exemplary-only issued U.S. patents. Stolpmann (U.S. Pat. No. 6,855,158) discloses in part a closed-loop control system for support surface temperature control, used in conjunction with a low air loss mattress. Harrison et al. (U.S. Pat. No. 6,859,967) discloses a mattress overlay and various air inflated bladders incorporating thermal control to regulate a patient's body temperature while also using pressure shifting techniques to reduce the risk of bed sore formation.

Gazes (U.S. Pat. No. 5,970,550) discloses a multiple compartment inflatable mattress which involves controlling the temperature of a circulated medium in order to control the mattress temperature. Stroh et al. (U.S. Pat. No. 5,168,589) discloses a pressure reduction air mattress (or alternatively an overlay) which uses adjustable air flow rates as well as heating elements for warming air passed therethrough or thereby. Heaton (U.S. Pat. No. 6,730,115) provides an inflatable mattress and related heat exchanger technology, intended in part for providing cooling contact for a person supported thereon, rather than heating, in order to provide cooling as part of a clinical treatment. Totton at al. (U.S. Pat. No. 6,782,574) relates to an air-powered low interface pressure support surface in which an air inflatable mattress and mattress coverlet are provided for the prevention and treatment of decubitus ulcers (i.e., pressure sores or bedsores).

Maier et al. (U.S. Pat. No. 6,223,369) is another example of various prior art patient support surfaces which make use of integrated air support cylinders surrounded by foam patient support features and collectively encased in a cover. Such basic combination of features provide one example of a patient support mattress to which additional features and modified features may be practiced in accordance with the presently disclosed subject matter, as further discussed herein. As background, FIGS. 1 and 2 herewith are taken from such '369 patent, and illustrate background subject matter as follows.

FIG. 1 is a generally top and partial side perspective view, in partial cutaway, of an exemplary prior art patient support surface. FIG. 2 is a cross sectional representation, taken generally along a middle position of the illustration of FIG. 1, representing as such prior art embodiment in part would appear in assembled form.

FIG. 1 illustrates an exemplary patient support surface generally 10 showing an exemplary exterior fitted cover 12, which may comprise such as stretch fabrics. A pleated design may be practiced for full integration with shear-relieving surfaces of foam toppers contained therein, and turning handles (not shown) may be optionally provided.

FIG. 1 represents a perimeter bolster 14 as illustrated in dotted line, as enclosed within covering 12. Such bolster 14 may include a pair of opposing longitudinal elements 16 and 18 and an opposing pair of end rails or elements 20 and 22 integrally associated therewith. Preferably, perimeter bolster 14 may comprise resilient polyurethane materials with selected characteristics. The several components 16, 18, 20, and 22 thereof may be joined by gluing or the like, as well understood by those of ordinary skill in the art.

As further shown in partial cutaway in exemplary prior art FIG. 1, a foam topper generally 24 may be integrally included within patient support surface 10. Particularly the upper support surface of such foam topper may include a variety of constructions designed and intended to facilitate pressure relief. Pressure relief, for example, may be provided by a number of lateral cuts or channels generally 26 formed in such surface as illustrated in solid line. It is to be understood that a number of longitudinal cuts or channels may also optionally be provided (as represented generally by dotted lines 28) for improved shear-relief performance or other improved features. As will be well understood by those of ordinary skill in the art, the combination of lateral channels 26 and longitudinal channels or cuts 28 results in a plurality of separate upright support elements, the size and construction of which may vary over the surface of topper 24 so as to provide selected support characteristics. Examples of such various arrangements as may be practiced in combination with the subject matter are discussed throughout commonly owned U.S. Pat. Nos. 4,862,538; 5,025,519; 5,252,278; and 5,580,504, the complete disclosures of which are fully incorporated herein by reference.

FIG. 1 further represents in the partial cutaway exposure thereof the fact that foam topper 24 may be provided with particular underside features for accommodating and receiving an air cylinders). In particular, the end generally 30 of an exemplary longitudinal air cylinder is represented as positioned near one end of patient support surface 10. Different numbers and sizes of generally longitudinal air cylinders may be practiced, and laterally-positioned air cylinders may also be practiced with certain variations.

FIG. 2 represents the exemplary use of four longitudinal air cylinders 36, 38, 40, and 42. Each such air cylinder has a respective end, at which a connection is made with a respective section of air tubing, which interconnects with the interior of the respective air cylinders to facilitate initially establishing the air pressure therein and/or later adjusting such amount of air pressure.

Another aspect of the exemplary prior art embodiment represented in present FIG. 2 is the inclusion of a pair of inner bolsters 68 and 70, which run longitudinally along the lengthwise axis of a patient support surface. As illustrated, each inner bolster 68 and 70 has a respectively inwardly facing concave surface which interacts with part of the curvature of respective air cylinders 36 and 42. Still further, each concave face is provided with at least one respective curved slot 76 and 78, respectively. FIG. 2 further represents additional aspects of the exemplary prior art mattress, with a plurality of depending elements (not marked) which form downwardly facing arches which interact and interface with the generally top sides of the respective air cylinders 36, 38, 40, and 42. Such resulting combination cradles and surrounds the air cylinders, to provide an interlocked, integrated design.

The FIG. 2 cross section also shows the placement relationship among the air cylinders and various exemplary foam components. The locations of a foam topper, perimeter bolster components 16 and 18, and inner or side bolsters 68 and 70 are all distinguished by the use of differentiated cross hatching, as will be well understood by those of ordinary skill in the art. A general outward path of an exemplary air tube is represented in dotted line by air tube 64. Wide welds 96, 98, and 100 are created for holding together adjacently respective pairs of air cylinders. In general, the air cylinders are integrally formed so as to be reinforced, fabricated from, for example, high tinsel woven nylon fabric fused to heavy gauge polymeric film.

FIG. 2 represents an overall support strategy achieved with the illustrated structural arrangement, enhanced by selectively utilizing foam having different support characteristics. For example, in relation to each other, perimeter bolster 14 (only components 16 and 18 thereof are represented in FIG. 2 may be of relatively more dense material for relatively greater support than side or inner bolsters 68 and 70, which in turn may be of relatively greater density or firmer support than a foam topper portion. For specific examples, it will be understood by those of ordinary skill in the art that various nomenclatures may describe support characteristics of a given piece of foam. In this instance, ILD is intended to refer to the known characteristic of so-called indentation load deflection. Indentation load deflection (ILD) may be defined as the number of pounds of pressure needed to push a 50 square inch circular plate into a pad a given percentage deflection thereof. For example, a 25 percent ILD of 30 pounds would mean that 30 pounds of pressure is required to push a 50 square inch circular plate into a four inch pad a distance of one inch (i.e., 25 percent of the original, unloaded thickness).

Using a 25 percent ILD characteristic for description purposes, perimeter bolster 14 (including all elements 16, 18, 20, and 22 thereof) may in some instances comprise about a 54 pound ILD, while side or inner bolsters 68 and 70 may each comprise about a 50 pound ILD and while a foam topper feature may comprise about a 35 pound ILD. Other ILD characteristics in a range of from about 25 pounds to 60 pounds, or in some instances, outside of such range, may be practiced, as desired.

The disclosures of all of the foregoing U.S. patents are fully incorporated herein by reference, for all purposes.

While various implementations of therapeutic mattresses or mattress coverlets have been developed, no design has emerged that generally encompasses all of the desired characteristics as hereafter presented in accordance with the subject technology.

SUMMARY OF THE DISCLOSURE

In view of the recognized features encountered in the prior art and addressed by the presently disclosed subject matter, improved apparatus and methodology for cooling effects in either patient-oriented or consumer-oriented products are provided. Further, per some embodiments, improved apparatus and methodology for controlling and/or moderating moisture and heat within a therapeutic support, or within a consumer-oriented product, are provided.

In exemplary embodiments, therapeutic mattresses or similar are provided with a self-powered air flow mechanism to foster beneficial air movement for addressing the amount of moisture and/or heat within a therapeutic mattresses or mattress coverlet.

It is to be understood by those of ordinary skill in the art that the terminology self-powered or non-powered or self-actuated as used in the presently disclosed subject matter means the ability to achieve air movement and/or moisture and/or heat movement or removal without requiring electrical power, either externally obtained (for example, from electrical service) or internally obtained (for example, from a battery or generating source). Such air movement and/or moisture and/or heat movement or removal encompasses all such movement caused by either natural convection or by movement of air either into of from a given location or area.

Another aspect of the presently disclosed subject matter (including devices and methodology) is that the impetus for movement of air, moisture, and/or heat is obtained from physical movement of a patient as supported on a therapeutic mattress or other patient or consumer support incorporating the presently disclosed subject matter.

In accordance with aspects of certain embodiments of the presently disclosed subject matter, methodologies are provided to achieve movement or circulation of air, and potentially including excess moisture and/or heat carried thereby, either within a therapeutic mattress or inward and/or outward relative to such mattress with the assistance of passageways connecting the exterior of the mattress with internal portions of a patient support surface provided thereby.

In other of the foregoing embodiments, such coverlet may comprise a low air loss structure, and such apparatus may further include a main patient support structure comprising an air flotation air mattress including its own respective air pump and associated regulator/valving structure. In some embodiments, such mattress coverlet may be associated with a multi-layer air mattress. In others, such coverlet may comprise a low air loss mattress coverlet having an upper support surface defining a plurality of such air outlets.

In some present exemplary embodiments of the presently disclosed subject matter, an integrated mattress system may be provided for circulating air relative to a patient by involving inclusion of a three-dimensional material in a main patient support structure, such structure having at least one air port or vent thereof coupled through such three-dimensional material with one or more air cylinders positioned to be manipulated by patient movement on an upper support surface. Such air cylinder or cylinders may have resilient internal structures, such as open-celled foam, so that air is exhausted out of such cylinder structures through tubing, into patient-supporting three-dimensional material, and out from such mattress via one or more an air ports. Similarly, when there is less patient pressure on a given location of the air cylinder structures, expansion of the cylinders may result, so that air is drawn back into such cylinder structures through one or more air ports, through the patient-supporting three-dimensional material, and through tubing into such cylinder structures. Dissipation of moisture and heat, in view of the non-crushable air flow area of support underneath at least a portion of a patient established herewith, also encompasses natural convection. In other words, as understood, natural convection of heat and moisture is that which moves from high heat and moisture environments to relatively lower heat and moisture environments. All such air movement in and through such three-dimensional non-crushable material beneath a supported patient, tends to beneficially reduce moisture and/or heat generated by such supported patient.

In other present exemplary embodiments, a cover of the mattress may be provided with a relatively high MVTR (Moisture Vapor Transmission Rate) to facilitate passage of moisture (for example, as generated by a patient's sweat) while still being water resistant.

In some present exemplary embodiments, a top layer may be replaced with a special material, for example, about 0.5 inches thick, that allows relatively high air flow. Generally speaking, the exhaust of associated air cylinders (integrally associated or otherwise) may be routed to the area under the back and buttocks of a supported patient. With such an arrangement, patient movement causes air to either exhaust out of the cylinders to under relatively high sweating areas of the seating and torso areas, or to be drawn away from such patient areas as the air is drawn back into the air cylinders. Such air movement causes heat and/or moisture of the body to be removed.

Per the presently disclosed subject matter, construction of a mattress with a relatively high air flow top layer (in effect, a three-dimensional spacer material) coupled with making use of the patient movement to assist heat and moisture removal is how some of the presently disclosed exemplary embodiments manage to achieve microclimate management without use of an electrically powered source for air movement.

One exemplary embodiment of presently disclosed subject matter relates to a user support system which beneficially provides for the removal of heat and moisture from the body of the user. Such exemplary user support system preferably comprises at least one air cell; an enclosure for such at least one air cell, such enclosure defining an upper support surface for a user; a spacer fabric positioned at least partially between such upper support surface and a user supported thereon; and at least one air passageway interconnecting such spacer fabric with such at least one air cell. With such an arrangement, preferably as a user moves on such upper support surface, such movement causes air relative to such at least one air cell to be moved relative to the user, to cause removal of heat and moisture from the body of the user.

In some alternative exemplary embodiments of such a user support system, such spacer fabric may be positioned under an area intended to encompass support for at least a portion of a user's back and buttocks.

In other present variations, such at least one air passageway may comprise a plurality of air cells pneumatically interconnecting via air tubing with such spacer fabric. Per other alternatives, such at least one air cell may comprise a plurality of air cells; and such enclosure may comprise a foam shell.

In some other variations of such exemplary embodiments, such plurality of air cells may comprise a respective plurality of air cylinders oriented one of length-wise and laterally within such foam shell; while such foam shell may be a multi-piece foam shell comprising a foam shell topper, foam bolsters, a foam header, and a foam footer.

In other alternatives, such spacer fabric may comprise two adjacently stacked layers of three-dimensional material. In some alternative variations, such spacer fabric may comprise a non-crush, three-dimensional fabric, comprised of at least one of knit, cloth, polymeric film, foam, and extruded woven fibers. In still others, such spacer fabric may comprise a material having fibers having lateral flexibility for reducing shear forces on a supported user's skin by providing a degree of lateral flexing during movement of a user. For yet others, such spacer fabric may comprise PES having a thickness of between about 0.5 to 0.6 inches. For still others, such spacer fabric may comprise a thickness having sufficient space and non-crush and air flow characteristics for allowing air movement below a user based either on generated by user movement or on generated by natural convection.

In other present variations of a presently disclosed exemplary user support system embodiment, a cover may be provided for removably encasing such foam shell and such spacer fabric, and such cover may include at least one vent formed therein for the passage of air therethrough. In some such variations, such vents may comprise jersey mesh material sewn into such cover. In yet others, such cover may comprise joined separate bottom and top pieces.

For other present variations, an exemplary patient support system may be modularly integrated with one of a mattress, a wheelchair/seating cushion, a patient positioner, a mattress coverlet, and a consumer-oriented support.

For other presently disclosed variations, an exemplary user support system may include a cover for removably encasing such enclosure, and such cover may include vents formed therein for the passage of air therethrough; such spacer fabric may be aligned under an area intended to support at least portions of a user's back and buttocks; such at least one air passageway may comprise air tubing pneumatically interconnecting such spacer fabric with such at least one air cell; and such enclosure may comprise a multi-piece foam shell. In some instances, such foam shell may comprise a multi-piece foam shell having a foam shell topper, foam bolsters, a foam header, and a foam footer. In some of such variations, pieces of such foam shell may comprise sections of foam having a 25 percent Indentation Load Deflection (ILD) characteristic in a range of from about 25 pounds to about 60 pounds.

In other variations of a presently disclosed exemplary patient support system, such foam shell may include an upper support surface having different respective sections for specialized support protocols. For some such variations, at least one of such sections may comprise a gel material. In other instances, such at least one air cell may include therein resilient elements comprising an open-celled foam interior.

For other present variations of a user support system, such at least one air cell may comprise a plurality of air cells respectively including therein resilient elements comprising open-celled foam interiors; such enclosure may comprise a foam shell including an upper support surface having different respective sections thereof for selected support characteristics; such spacer fabric may comprise a non-crush, three-dimensional fabric; such at least one air passageway may comprise air tubing connecting such spacer fabric with such plurality of air cells; and such user support system may further include a cover for removably encasing at least such foam shell and such spacer fabric, and with such cover including at least one vent formed therein for the passage of air therethrough.

Yet another presently disclosed exemplary embodiment relates to a self-powered microclimate controlled patient support surface. Such a surface preferably comprises a patient support having at least one integrated air cell; a spacer fabric situated between at least a portion of such patient support and at least a portion of a patient supported thereon, to create a non-crushable area of support below at least a portion of such supported patient; and air tubing connected between such at least one integrated air cell and such spacer fabric. With such an arrangement, advantageously air is moved relative to a supported patient as a patient's physical movement causes air to be expelled from or drawn into such at least one air cell via such spacer fabric and such air tubing, to provide unpowered cooling effects to the supported patient.

In some variations of the foregoing, such patient support system may be modularly integrated with one of a mattress, a wheelchair/seating cushion, a patient positioner, a mattress coverlet, and a consumer-oriented support.

In other variations, such patient support may comprise resilient foam support including a mattress having at least one foam section.

For other presently disclosed alternatives, an exemplary patient support surface embodiment may further comprise a cover with at least one vent for passage of air therethrough either expelled from such spacer fabric or drawn therein. In some variations of the foregoing, such patient support surface may be integrated into a mattress system; such cover may comprise a moisture permeable material; and such spacer fabric may comprise a material less than about 1.0 inches thick. In some alternatives thereof, such mattress system may further include an integrated sensor system for sensing at least one of temperature, moisture, and pressure of such mattress system. In others, such mattress system may further include a protective zippered sheath thereover.

Per other present alternatives of the foregoing, such patient support may include a foam topper having a plurality of surface cuts and channels forming a plurality of separate upright support elements, the size and construction of which are predetermined over the surface of such foam topper so as to provide selected support characteristics to a patient supported thereon.

For some variations, such at least one integrated air cell may comprise a plurality of respective air cylinders. For others, such plurality of respective air cylinders may respectively comprise cylinders integrally formed from woven nylon fabric fused to polymeric film.

For still other alternatives of the foregoing arrangements, such patient support may include a plurality of such air cells with resilient support foam received between such air cells and a patient supported on such patient support.

Another presently disclosed exemplary embodiment relates to a self-actuated microclimate for the prevention and treatment of tissue damage of a patient received on a support surface. Such microclimate preferably comprises a resilient patient support, having at least one integrated air cell, and forming a patient support surface; and a non-crushable area of support relative to at least a portion of the patient support surface, such non-crushable area of support comprising materials for maintaining air flow capabilities in such area even while supporting a patient, to allow for the removal of moisture and/or heat from below a supported patient.

In some variations of the foregoing, such microclimate may further comprise pneumatic interconnection between such non-crushable area and such at least one integrated air cell, so that physical movement of a patient received on such patient support surface may cause air to be expelled from or drawn into such at least one integrated air cell via such pneumatic interconnection, which in turn results in air movement relative to such non-crushable area, resulting in removing moisture and/or heat from beneath a patient received on such patient support surface. In others, such microclimate may further comprise at least one vent for at least partially venting such non-crushable area of support to the surrounding environment, so that natural convection between the surrounding environment and air beneath a patient in such non-crushable area of support may result in removing moisture and/or heat from beneath a patient received on such patient support surface.

Per some alternatives of the foregoing, such resilient patient support may comprise a mattress which is at least partially made of foam.

For others, such microclimate may further comprise pneumatic connection between such non-crushable area and such at least one integrated air cell and the surrounding environment, so that physical movement of a patient received on such patient support surface and natural convection may result in removing moisture and/or heat from beneath a patient received on such patient support surface.

In the case of some further alternatives of the foregoing microclimate, such patient support surface may be integrated with one of a mattress, a wheelchair/seating cushion, a patient positioner, a mattress coverlet, and a consumer-oriented support.

In yet other variations thereof, such resilient patient support may comprise a multi-piece foam shell including at least a foam shell topper, a foam header, and a foam footer; and such pneumatic connection may comprise interconnecting air tubing between such non-crushable area and such at least one integrated air cell. For other presently disclosed alternatives, such patient support may include a foam topper having a plurality of surface cuts and channels forming a plurality of separate upright support elements, the size and construction of which are predetermined over the surface of such foam topper so as to provide selected support characteristics to a patient supported thereon.

For some variations of the presently disclosed microclimate, wherein such patient support may include a plurality of such air cells, and such resilient patient support includes at least in part resilient support foam received between such air cells and a patient supported on such patient support. Per others, an exemplary microclimate hereof may further comprise a cover around such resilient patient support and such non-crushable area of support with at least one vent through such cover for passage of air therethrough either expelled from such non-crushable area of support or as drawn therein, or from natural convection.

Yet for other presently disclosed alternative microclimate embodiments, such patient support surface may be integrated into a mattress system; such cover may comprise a moisture permeable material; and such non-crushable area of support may comprise an air flow friendly material less than about 1.0 inches thick. In still other presently disclosed alternative microclimate embodiments, such at least one integrated air cell may comprise a plurality of air cylinders oriented one of length-wise and laterally within such resilient patient support, with such air cylinders positioned to be manipulated by patient movement on such resilient patient support; and such non-crushable area of support may be situated to support at least part of a patient's back and buttocks whenever a patient is received on such patient support surface.

Per some further alternatives thereof, such mattress system may further include an integrated sensor system for sensing at least one of temperature, moisture, and pressure of such mattress system. For others, such cover may comprise a protective zippered sheath over such mattress system.

In other present alternative such microclimates, such at least one integrated air cell thereof may comprise a plurality of respective air cylinders. Per some of such alternatives, such plurality of respective air cylinders may each include respective resilient internal structures, so that with relatively less patient pressure on a given location of such air cylinders, expansion of such cylinders by their respective resilient internal structures causes air to be drawn back into such cylinders through such at least one vent, through such non-crushable area of support through such pneumatic connection. Further, in come such instances, such plurality of respective air cylinders may each have respective generally rectangular cross-sections.

Still further, it is to be understood that present exemplary embodiments equally relate to corresponding methodologies. For example, one presently disclosed method relates to methodology for providing a self-powered microclimate for the prevention and treatment of decubitus ulcers of a patient received on a support surface. Such exemplary embodiment preferably comprises providing a resilient patient support, having at least one integrated air cell, and forming a patient support surface; providing a non-crushable area of support relative to at least a portion of the patient support surface; pneumatically interconnecting such non-crushable area with the at least one integrated air cell; and supporting a patient on such patient support surface with at least a portion of the patient received adjacent the non-crushable area of support. With such an arrangement, physical movement of such patient received on the patient support surface causes air to be expelled from or drawn into the at least one integrated air cell via such pneumatic interconnection, which in turn results in air movement relative to such non-crushable area, resulting in cooling effects by removing moisture and/or heat from adjacent the patient.

In some presently disclosed alternatives of such exemplary methodology, an exemplary method may further include modularly integrating such patient support surface with one of a mattress, a wheelchair/seating cushion, a patient positioner, a mattress coverlet, and a consumer-oriented support. Per other present variations, an exemplary method may further comprise providing a cover around such resilient patient support and such non-crushable area of support with at least one vent through such cover for passage of air therethrough either expelled from such non-crushable area of support or as drawn therein. In variations of the foregoing, such patient support surface may be integrated into a mattress system; such cover may comprise a moisture permeable material; and such non-crushable area of support may comprise a material less than about 1.0 inches thick. In other variations thereof, such at least one integrated air cell may comprise a plurality of air cylinders oriented one of length-wise and laterally within such resilient patient support, with such air cylinders positioned to be manipulated by patient movement on such resilient patient support; and supporting such patient may include receiving at least part of a patient's back and buttocks adjacent such non-crushable area of support.

In other presently disclosed variations to the foregoing methodology, for an exemplary method, providing such resilient patient support may comprise providing a multi-piece foam shell including at least a foam shell topper, a foam header, and a foam footer; and such pneumatically interconnecting may comprise interconnecting air tubing between such spacer fabric and such at least one integrated air cell.

In another variation of the foregoing, such resilient patient support may comprise a mattress which is at least partially made of foam. For others, such patient support surface may be integrated into a mattress system; such cover may comprise moisture permeable material; and such non-crushable area of support may comprise a material less than about 1.0 inches thick.

For still other alternatives such mattress system may further include an integrated sensor system for sensing at least one of temperature, moisture, and pressure of such mattress system.

Per some variations, such cover may comprise a protective zippered sheath over such mattress system.

In other alternatives, such patient support may include a foam topper having a plurality of surface cuts and channels forming a plurality of separate upright support elements, the size and construction of which are predetermined over the surface of such foam topper so as to provide selected support characteristics to a patient supported thereon.

For yet other alternatives, in some instances such at least one integrated air cell may comprise a plurality of respective air cylinders. For some such alternatives, such plurality of respective air cylinders each may include respective resilient internal structures, so that with relatively less patient pressure on a given location of such air cylinders, expansion of such cylinders by their respective resilient internal structures may cause air to be drawn back into such cylinders through such at least one vent, through the non-crushable area of support through the pneumatic interconnection.

For some instances, such plurality of respective air cylinders each may have respective generally rectangular cross-sections. For other instances, such plurality of respective air cylinders respectively may comprise cylinders integrally formed from woven nylon fabric fused to polymeric film.

Yet some other variations of the foregoing, such patient support may include a plurality of such air cells, and such resilient patient support may include at least in part resilient support foam received between such air cells and a patient supported on such patient support.

Another presently disclosed exemplary embodiment of methodology relates to providing a self-actuated microclimate for the prevention and treatment of tissue damage of a patient received on a support surface. Such methodology preferably comprises providing a resilient patient support, having at least one integrated air cell, and forming a patient support surface; providing a non-crushable area of support relative to at least a portion of the patient support surface, with such non-crushable area of support maintaining air flow capabilities in such area even while supporting a patient; and supporting a patient on such patient support surface with at least a portion of the patient received above the non-crushable area of support, so that air movement capability is maintained relative to such non-crushable area, to allow for the removal of moisture and/or heat from below a supported patient.

One exemplary variation of the foregoing methodology involves further including pneumatically interconnecting such non-crushable area with the at least one integrated air cell, so that physical movement of a patient received on the patient support surface may cause air to be expelled from or drawn into the at least one integrated air cell via such pneumatic interconnection, which in turn may result in air movement relative to such non-crushable area, resulting in removing moisture and/or heat from beneath the patient. Another exemplary variation of the foregoing involves further including at least partially venting such non-crushable area of support to the surrounding environment, so that natural convection between the surrounding environment and air beneath a patient in such non-crushable area of support may result in removing moisture and/or heat from beneath the patient. Still another variation may involve further including pneumatically connecting such non-crushable area with the at least one integrated air cell and the surrounding environment, so that physical movement of a patient received on the patient support surface and natural convection may result in removing moisture and/or heat from beneath the patient.

In another alternative exemplary embodiment of the presently disclosed methodology, such resilient patient support may comprise a mattress which is at least partially made of foam. Others may further include pneumatically interconnecting such non-crushable area with the at least one integrated air cell. In some instances, such methodology may further include modularly integrating such patient support surface with one of a mattress, a wheelchair/seating cushion, a patient positioner, a mattress coverlet, and a consumer-oriented support.

Other variations of the presently disclosed methodology may include providing such resilient patient support to comprise providing a multi-piece foam shell including at least a foam shell topper, a foam header, and a foam footer; and such pneumatically interconnecting to comprise interconnecting air tubing between such non-crushable area and such at least one integrated air cell. In still other alternatives, for some presently disclosed exemplary embodiments of methodology, such patient support may include a foam topper having a plurality of surface cuts and channels forming a plurality of separate upright support elements, the size and construction of which are predetermined over the surface of such foam topper so as to provide selected support characteristics to a patient supported thereon.

In some present alternative methodologies, such patient support may include a plurality of such air cells, and such resilient patient support may include at least in part resilient support foam received between such air cells and a patient supported on such patient support.

For still further alternatives, presently disclosed methodology may further comprise providing a cover around such resilient patient support and such non-crushable area of support with at least one vent through such cover for passage of air therethrough either expelled from such non-crushable area of support or as drawn therein, or from natural convection. Per some alternatives, such patient support surface may be integrated into a mattress system; such cover may comprise a moisture permeable material; and such non-crushable area of support may comprise an air flow friendly material less than about 1.0 inches thick.

In some presently disclosed alternative methodologies, such at least one integrated air cell may comprise a plurality of air cylinders oriented one of length-wise and laterally within such resilient patient support, with such air cylinders positioned to be manipulated by patient movement on such resilient patient support; and supporting such patient may include receiving at least part of a patient's back and buttocks adjacent such non-crushable area of support. In other variations, such mattress system may further include an integrated sensor system for sensing at least one of temperature, moisture, and pressure of such mattress system.

Yet for some other variations, such cover may comprise a protective zippered sheath over such mattress system.

Per other presently disclosed variations of exemplary methodology, such at least one integrated air cell may comprise a plurality of respective air cylinders. For some such variations, such plurality of respective air cylinders may each include respective resilient internal structures, so that with relatively less patient pressure on a given location of such air cylinders, expansion of such cylinders by their respective resilient internal structures causes air to be drawn back into such cylinders through such at least one vent, through the non-crushable area of support through the pneumatic interconnection. Per yet other of some variations, such plurality of respective air cylinders each may have respective generally rectangular cross-sections.

Additional objects and advantages of the presently disclosed subject matter are set forth in, or will be apparent to those of ordinary skill in the art from, the detailed description herein. Also, it should be further appreciated that modifications and variations to the specifically illustrated, referenced, and/or discussed features, steps, and elements hereof may be practiced in various embodiments and uses of the presently disclosed subject matter without departing from the spirit and scope of the subject matter. Variations may include, but are not limited to, substitution of equivalent means, features, or steps for those illustrated, referenced, or discussed, and the functional, operational, or positional reversal of various parts, features, steps, or the like.

Still further, it is to be understood that different embodiments, as well as different presently preferred embodiments, of the presently disclosed subject matter may include various combinations or configurations of presently disclosed features, steps, or elements, or their equivalents (including combinations of features, parts, or steps or configurations thereof not expressly shown in the figures or stated in the detailed description of such figures). Additional embodiments of the presently disclosed subject matter, not necessarily expressed in the summarized section, may include and incorporate various combinations of aspects of features, components, or steps referenced in the summarized objects above, and/or other features, components, or steps as otherwise discussed in this application. Those of ordinary skill in the art will better appreciate the features and aspects of such embodiments, and others, upon review of the remainder of the specification.

BRIEF DESCRIPTION OF THE DRAWINGS

A full and enabling disclosure of the presently disclosed subject matter, including the best mode thereof, directed to one of ordinary skill in the art, is set forth in the specification, which makes reference to the appended figures, in which.

Figure 1:
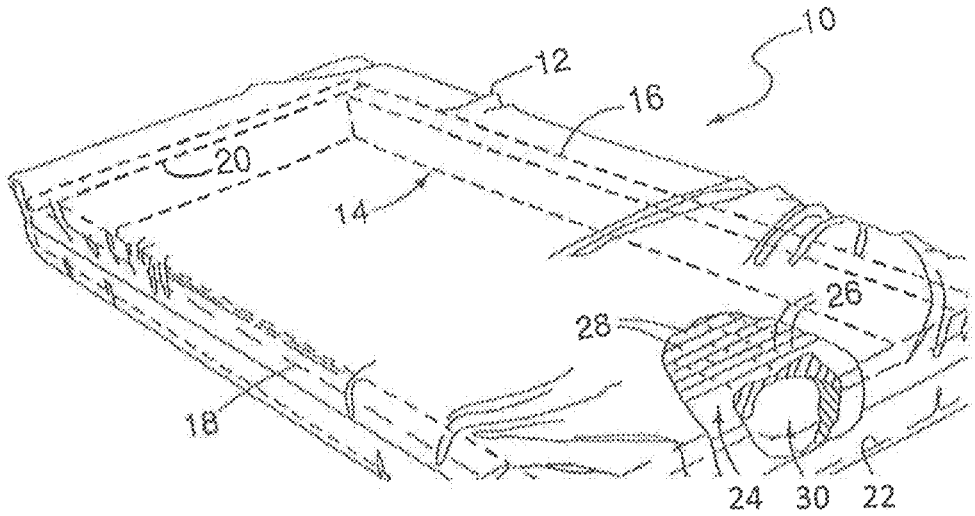
FIG. 1 (Prior Art)
FIGS. 1 and 2 are, respectively, a generally top and partial side perspective view, in partial cutaway, and a cross sectional representation (taken generally along a middle position of the illustration of FIG. 1) of an exemplary prior art patient support surface, as discussed above in detail.
Figure 2:
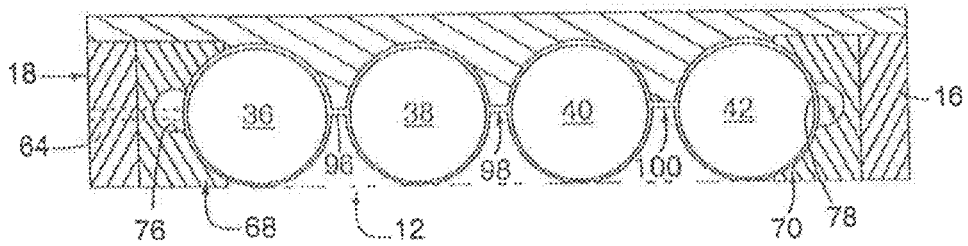
FIG. 2 (Prior Art)

Repeat use of reference characters throughout the present specification and appended drawings is intended to represent same or analogous features, elements, or steps of the presently disclosed subject matter.

DETAILED DESCRIPTION OF THE PREFERRED EMBODIMENTS

As discussed in the Summary of the Disclosure section, the presently disclosed subject matter is particularly concerned with apparatus and methodology for controlling the level of moisture and/or heat within a therapeutic mattresses or similar apparatus (or other context, such as wheel chair or other patient or consumer support) provided in accordance with presently disclosed subject matter.

Selected combinations of aspects of the disclosed technology correspond to a plurality of different embodiments of the presently disclosed subject matter. It should be noted that each of the exemplary embodiments presented and discussed herein should not insinuate limitations of the presently disclosed subject matter. Features or steps illustrated or described as part of one embodiment may be used in combination with aspects of one or more other present embodiment to yield yet further embodiments. Additionally, certain features or steps may be interchanged with similar devices, features or steps not expressly mentioned but which perform the same or similar function.

Referring collectively to FIGS. 3A, 3B, 4A, 4B, 5A, 5B, and 6, a presently disclosed exemplary air and foam flotation mattress generally 102 has a foam shell portion including foam bolsters 122 and foam sides 124 running the length of the mattress 102 and on either side thereof. At the respective ends of the air flotation mattress 102 and capping the foam bolsters and sides 122 and 124 are, respectively, a foam header 126 adjacent head end 156 and foam footer 128 adjacent foot end 158, which along with the bolsters 122 form a cavity in the mattress 102. Such cavity (not numbered) is configured for positioning of air cells 135 therein. As seen from the various present figures, such exemplary selected plurality of air cells 135 in this exemplary embodiment may run from head to foot, received within such cavity. Other configurations, including different pluralities of air cells, and/or orientations and/or locations thereof may be practiced in various embodiments, as understood by those of ordinary skill in the art.

Location 144 (shown by present FIG. 5A) illustrates an exemplary possibility of additional subject matter (for example, such as a sensor system, such as for temperature or moisture or pressure) included with mattress 102, but located so as to not interfere with any of the exemplary air cells 135. Details of any such adjacent devices form no particular part of the presently disclosed subject matter, beyond the exemplary location thereof relative to the remaining presently disclosed structure.

Figure 3A:
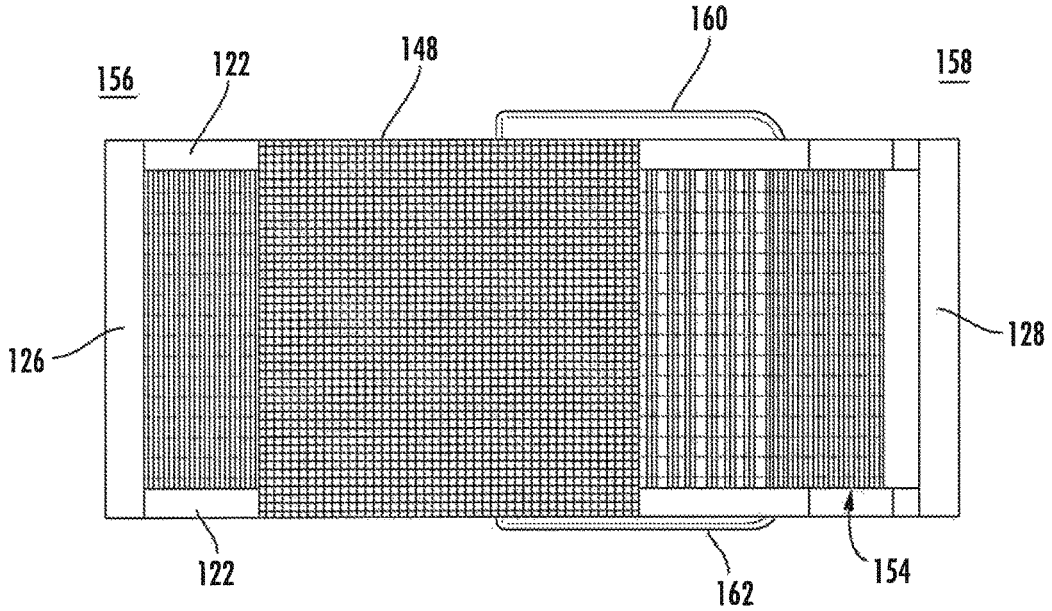
FIGS. 3A and 3B are generally top and side elevational views, respectively, of certain aspects of patient support surface features in accordance with presently disclosed subject matter.
Figure 3B:
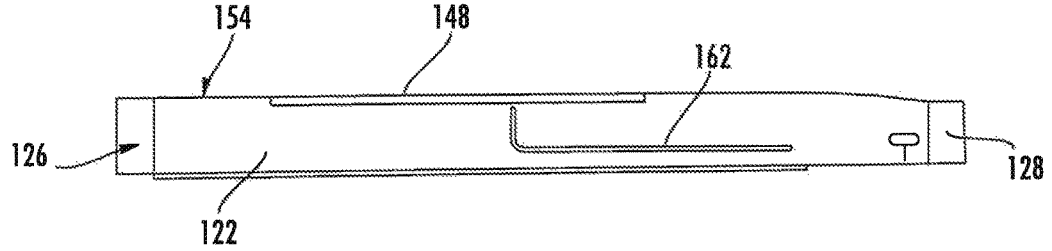
Figure 4A:
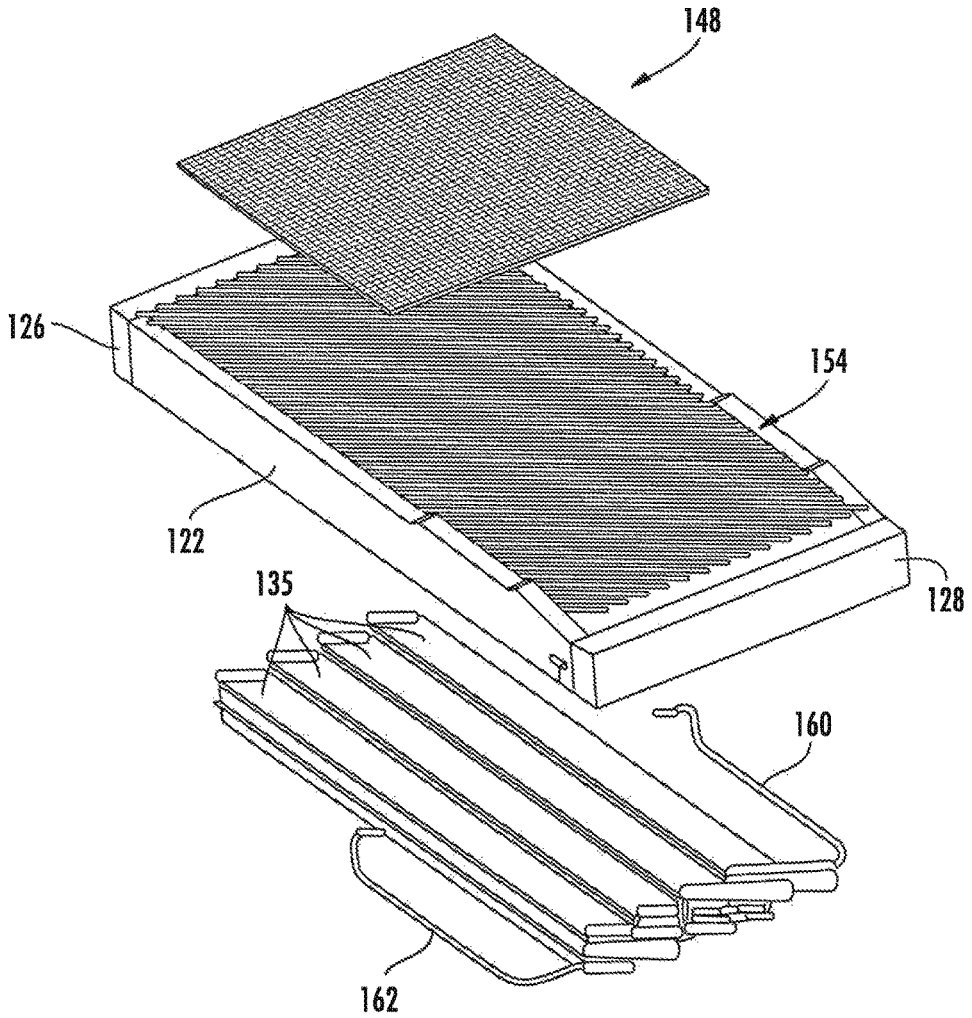
FIGS. 4A and 4B are generally perspective exploded view, and end view, respectively, of the exemplary presently disclosed subject matter of present FIGS. 3A and 3B.
Figure 5A:
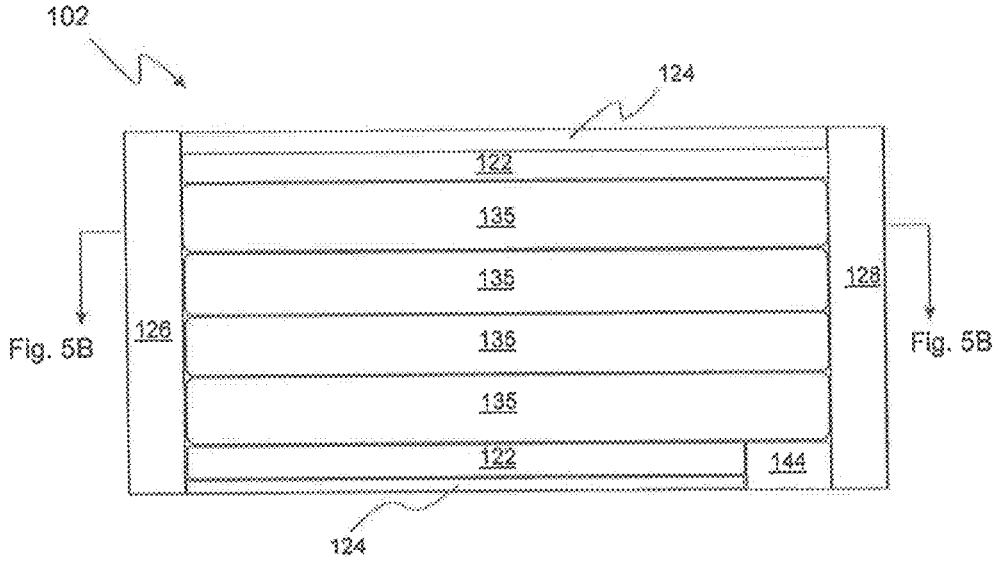
FIGS. 5A and 5B are generally top elevational and cross sectional views, respectively, of certain aspects of patient support surface features in accordance with presently disclosed subject matter.
Figure 5B:
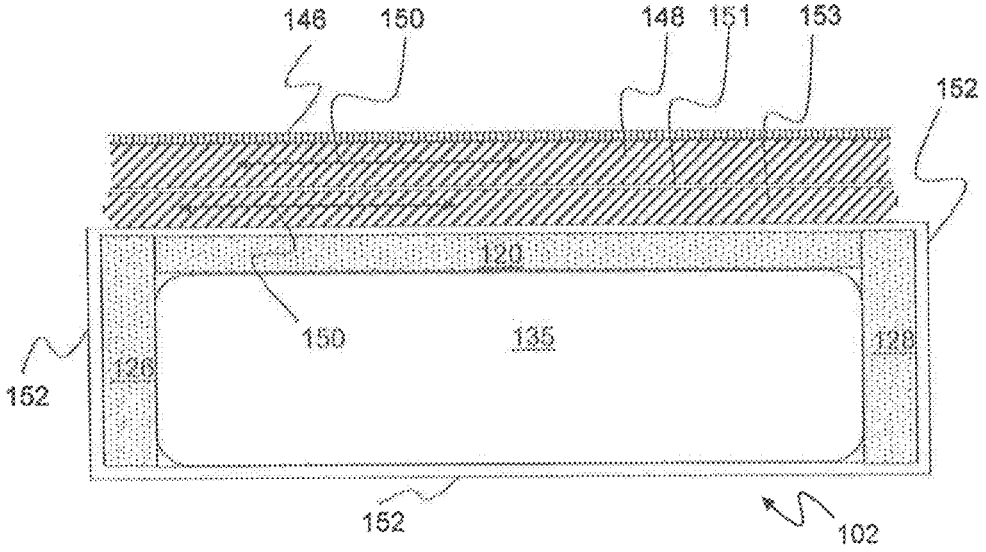
Figure 6:
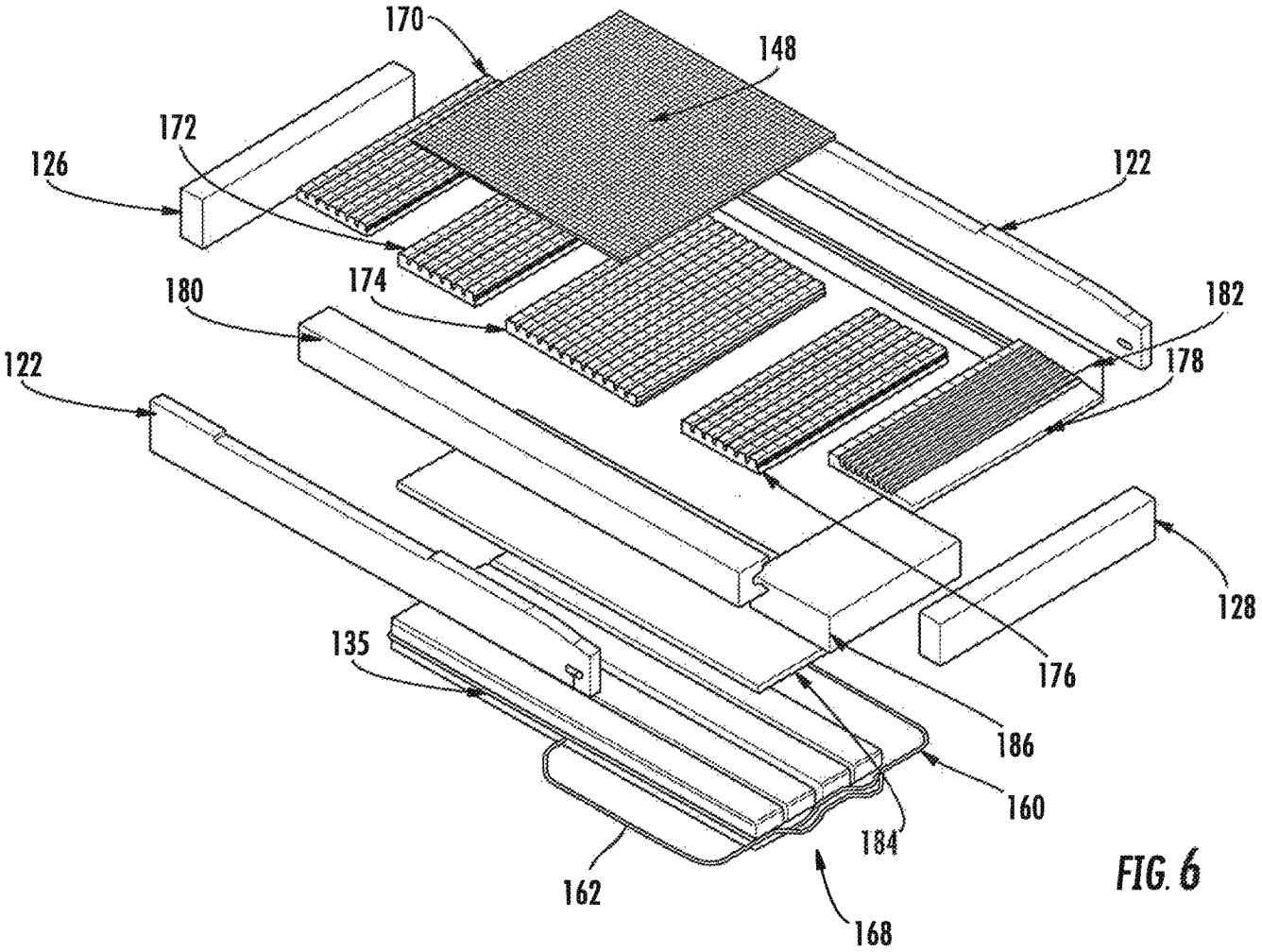
FIG. 6 is a generally side and front perspective view (exploded) of many features of an exemplary patient support surface embodiment in accordance with presently disclosed subject matter, but with any cover features thereof removed for clarity.

The cross section of present FIG. 5B represents that a foam section generally 120 may be received above air cells 135, to further help form the cavity within which such air cells are received. While the illustration of foam section 120 is general, to represent a variety of foam configurations that may be practiced, other present figures, such as present FIGS. 3A and 4A illustrate relatively more advanced, specialized foam surfaces and/or foam/gel configurations which may also be practiced in accordance with presently disclosed subject matter. FIG. 6 additionally shows an exploded view, which represents different respective sections or subportions 170, 172, 174, 176, and 178 which may be practiced for specialized support protocols, and may be glued or otherwise joined together to form upper foam support surface, generally 154 or 120.

Such figures variously illustrate an additionally presently disclosed feature, relating to a spacer or three-dimensional fabric portion generally 148 which may be positioned above at least a portion of upper support surface 154 or 120. Preferably, as illustrated (particularly by present FIGS. 3A, 4A, and 6), such spacer fabric portion may be aligned with areas under a patient's or user's back and buttocks. With air tubing or conduits (air passageways) interconnecting the spacer fabric to the air cylinders, as the patient moves, such movement causes air vis-à-vis the cylinders to be circulated under the patient's relatively high sweating areas of the seating and torso areas. Such air movement (whether being blown out of the mattress or drawn into the mattress) causes heat and moisture of the body to be removed.

As illustrated by such features, tubing generally 168 may interconnect the ends of air cells 135 (for example, on the foot support end of mattress 102), and then communicate air (in either direction) to spacer fabric 148 such as by respective tubing lines 160 and 162, all as illustrated. Different arrangements of tubing or similar devices may be utilized, so long as air passages are formed between the interior of the air cells 135 and the interior of spacer material 148, and spacer material 148 is in turn vented to (in air communication with) the exterior of mattress 102.

Other features may also be varied in particular embodiments. For example, the exploded view of present FIG. 6 further illustrates various internal foam bolster elements 180 and 182, and other internal foam components 184 and 186, but all such components may be varied to accommodate particular embodiments, so long as an internal cavity receives air cells for reacting to a patient's movement, to stimulate air movement relative to the patient's core area.

Various alternative spacer fabrics may likewise be practiced, so long as sufficient non-crushable air flow space is created below a patient for the air movement described herein. In one exemplary preferred embodiment, such spacer fabric may comprise Pressless article SFE 15 W220 made out of 100% PES (Polyethersulfone, a thermoplastic polymer) at a thickness of 15 mm (0.6"). Such spacer fabric has favorable characteristics also for preventing shear effects. As understood by those of ordinary skill in the art, the durometer (hardness) of such fabric may be controlled by thickness and density of the internal fibers, and the density of the outer layers being connected by such internal fibers. More generally, it may be appreciated that such spacer layer may comprise a generally non-crush, three-dimensional fabric, air flow-friendly material such as a knit, cloth, polymeric film, foam or extruded woven fibers. The structure of the spacer layer results not only in its non-crush characteristic, which is taken advantage of per the presently disclosed subject matter, but also the favorable shear effects referenced herein. Specifically, lateral flexibility of fibers or internal structure of the spacer fabric reduce shear forces on a supported patient's skin by providing a degree of upper surface lateral flexing during movement of a patient or user.

Still further, those of ordinary skill in the art will appreciate that variations of nearly all dimensions shown or suggested herewith may be practiced to provide or accommodate for specifically desired embodiments, to satisfy different ranges of patient needs, such as pediatric patients or even bariatric patients. All such variations are intended as coming within the spirit and scope of the presently disclosed subject matter, and dimensional examples herewith are presented without limitation on such alternatives.

Figure 4B:
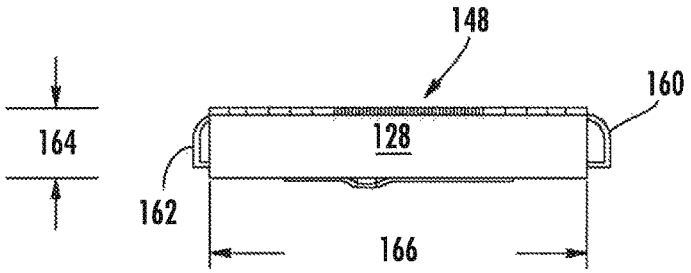

Present FIG. 4B designates two particular dimensional relationships in terms of thickness and width of an exemplary mattress 102. For such example, thickness 164 may be about 7.0 inches±0.5 inches, and length 166 may be about 35.5 inches±0.5 inches. In present FIG. 3B, the exemplary embodiment may be about 80 inches in length, ±0.75 inches.

Present FIG. 5B represents other features and optional features of presently disclosed subject matter. For example, mattress 102 may include or not include a perimeter feature generally 152. Further, the spacer fabric is illustrated in some present figures as a single body of material, while present FIG. 5B represents that such spacer material may in fact be separated into two separate parts 148 and 153, if desired, for achieving a particular cumulative thickness, and/or for accommodating any desired sheer characteristics of the upper support surface in particular embodiments. A separation is illustrated by reference 151 between separated parts 148 and 153 but such reference 151 may reflect either a physical layer or merely a joint where two spacer fabric pieces are adjacent each other. Double-headed air flow arrows 150 (appearing in both spacer fabric portions 148 and 153) represent that air is capable of moving in all directions below the patient or user. In other words, this represents air movement from the air cells to out of vents in mattress 102 (via tubing and the spacer fabric) and back into the air cells drawn into such vents (and passing through the spacer fabric and the tubing), as well as movement around or within the spacer fabric(s). Therefore, the tubing pneumatically interconnects the spacer fabric with the air cells so that, as the patient moves, such movement causes air vis-à-vis the air cells or cylinders to be circulated under the patient's relatively high sweating areas of the seating and torso areas. All such achieved air movement, and corresponding potential movement/dissipation of moisture and heat, are intended as being encompassed by the presently disclosed subject matter. Those of ordinary skill in the art will understand from the complete disclosure herewith that such dissipation of moisture and heat, in view of the non-crushable air flow area of support underneath at least a portion of a patient established herewith, also encompasses natural convection. In other words, as understood, natural convection of heat and moisture is that which moves from high heat and moisture environments to relatively lower heat and moisture environments. Thus, the self-powered movement of air discussed herewith assists, augments, or supplements the natural convection otherwise achievable with the structure established with the present subject matter.

Double-headed arrows 150 also represent lateral internal flexing of spacer fabric material, resulting in improved shear effects performance of the presently disclosed subject matter, as otherwise referenced herein.

Such spacer fabric(s) has a cover material generally 146 with a relatively high MVTR (Moisture Vapor Transmission Rate) to facilitate passage of moisture/sweat while still being water resistant. Other additional layers may comprise a waterproof, vapor impermeable sheet for protection of the underlying mattress 102. Such additional layer or layers may also additionally comprise a zippered sheath for encasing the mattress 102. Notably, the spacer fabric arrangement with the remaining structure herewith would offer some degree of benefit of cooling (such as in a consumer context) even if air cells were not utilized as represented herewith for moving air in response to the user's movements on the support surface.

Thus, in some present exemplary embodiments of the presently disclosed subject matter, an integrated mattress system may be provided for circulating air relative to a patient by involving inclusion of a three-dimensional or spacer material in a main patient support structure, such structure having at least one air port or vent thereof coupled through such three-dimensional material with one or more air cylinders positioned to be manipulated by patient movement on an upper support surface. Such air cylinder or cylinders may have resilient internal structures, such as open-celled foam, so that air is exhausted out of such cylinder structures through tubing, into patient-supporting three-dimensional material, and out from such mattress via one or more an air ports. Similarly, with less patient pressure on a given location of the air cylinder structures, expansion of the cylinders may result, so that air is drawn back into such cylinder structures through one or more air ports, through the patient-supporting three-dimensional material, and through tubing into such cylinder structures. As otherwise referenced herein, the presently disclosed structure also allows for natural convection, which can result in movement of moisture and/or heat away from an area underneath at least a portion of a patient. All such air movement (due to forced or drawn air, or due to natural convection) beneath a supported patient in and through such three-dimensional non-crushable material, tends to beneficially reduce moisture and/or heat generated by such supported patient. The cross sectional view of present FIG. 5B represents such open-celled foam included in a sectioned exemplary air cell 135.

As also represented by the various figures, while air cells 135 may assume particular shapes or locations, a generally rectangular shape (with or without rounded edges) forms a useful and effective arrangement of such air cells for the various air cell purposes related herein.

In general, present FIGS. 3A through 6 illustrate features of the presently disclosed subject matter with any outside cover removed, for greater clarity of such illustrated inside details. On the other hand, present FIGS. 7 though 10C illustrate various features of such outside cover aspects of presently disclosed subject matter, with other features generally omitted for clarity of the indicated illustrations. Otherwise, present FIG. 1 (though itself literally an illustration of a prior art device) is intended to represent the position of an external cover around a foam support chassis having internal air cylinders.

Figure 7:
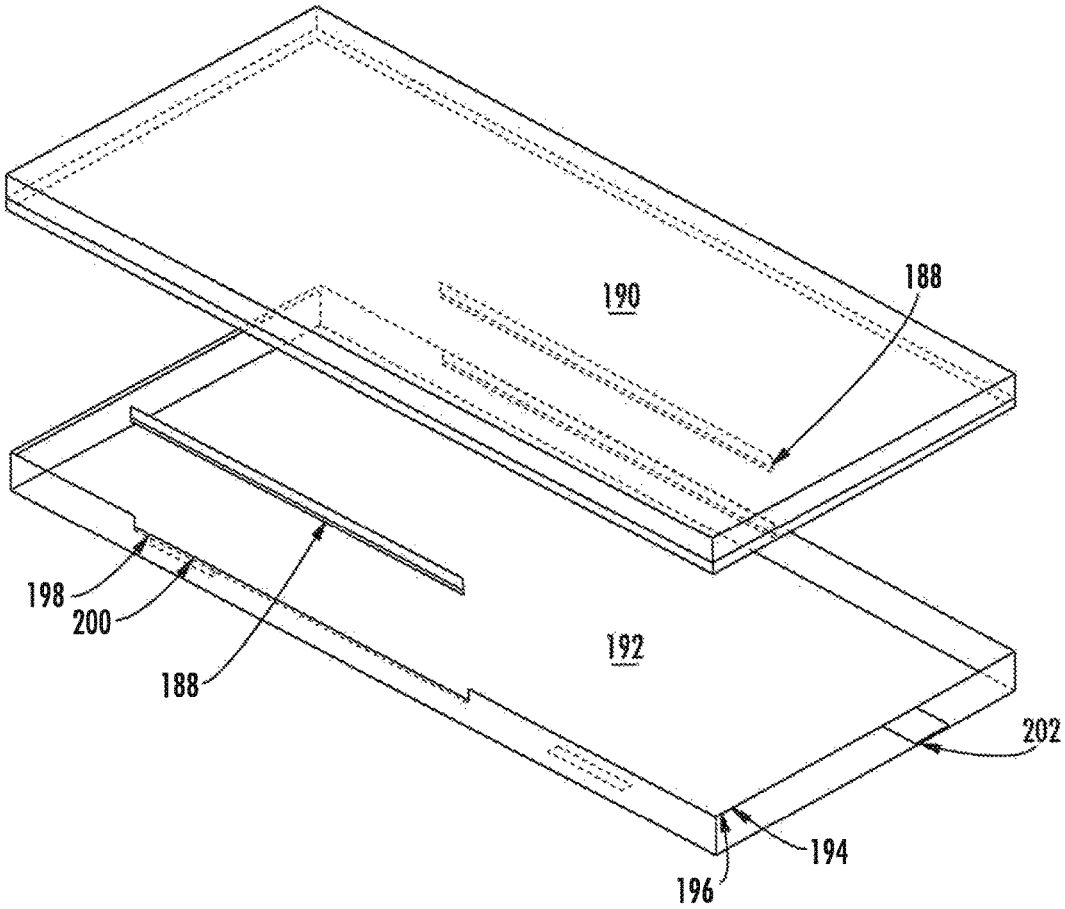
FIG. 7 is a generally top and side perspective view, separated, of top and bottom pieces collectively forming an exemplary cover in accordance with presently disclosed subject matter.
Figure 8:
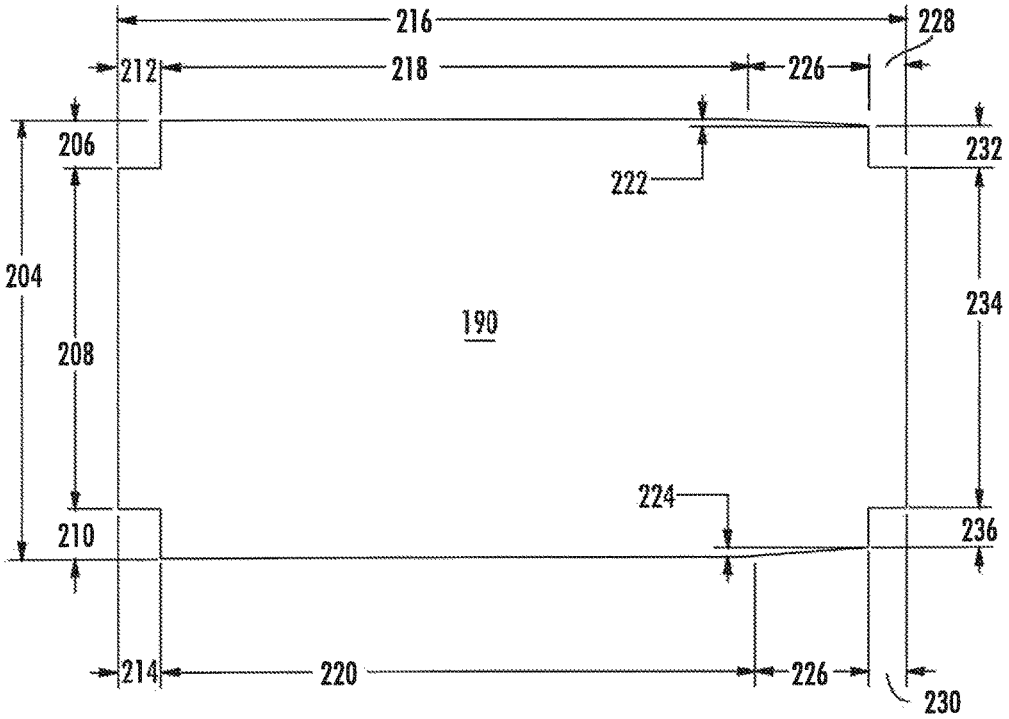
FIG. 8 is a plan elevational view of a top cover piece portion of an exemplary embodiment of the present FIG. 7 exemplary cover in accordance with presently disclosed subject matter.
Figure 9B:
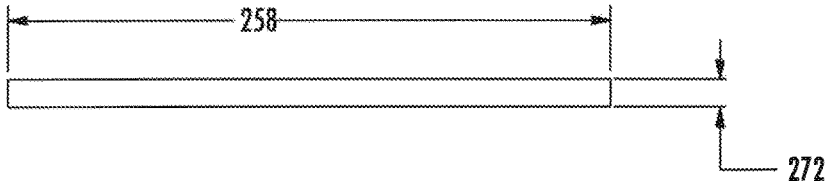
FIG. 9B is a side elevational view thereof.
Figure 9A:
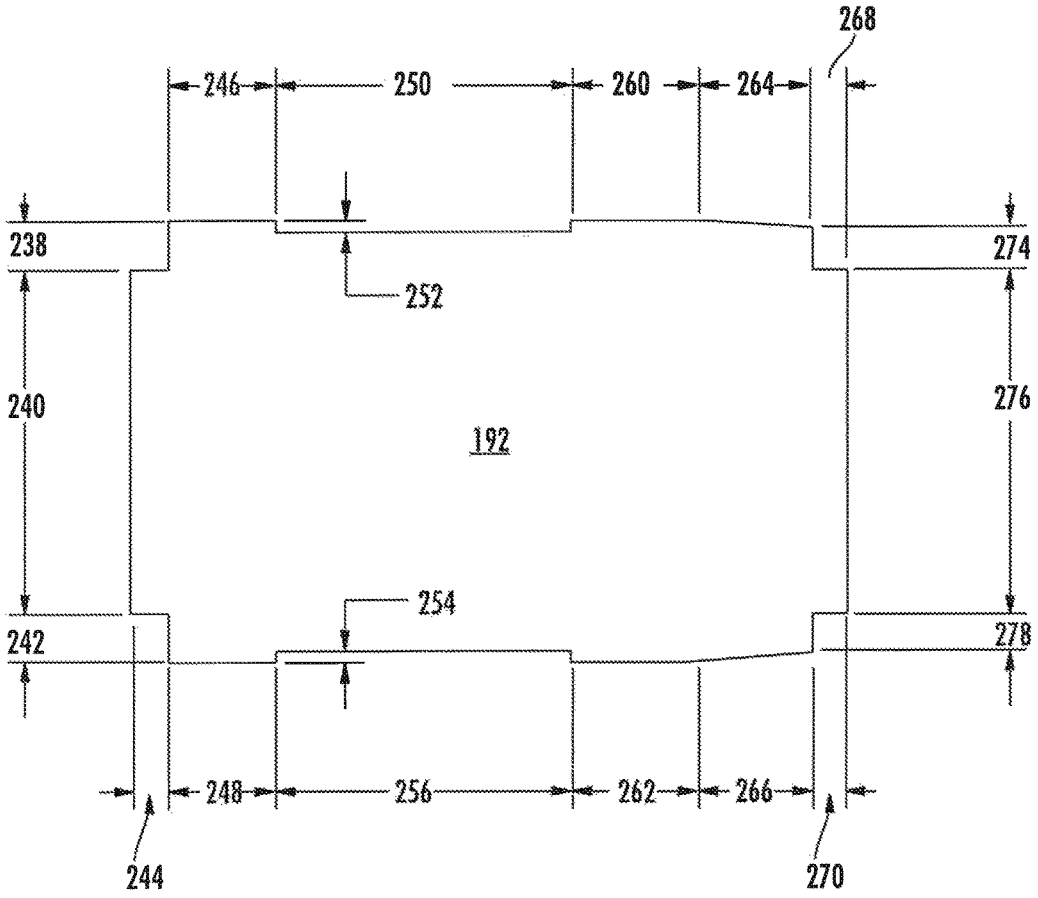
FIG. 9A is a plan elevational view of a bottom cover piece portion of an exemplary embodiment of the present FIG. 7 exemplary cover in accordance with presently disclosed subject matter.
Figure 10A:
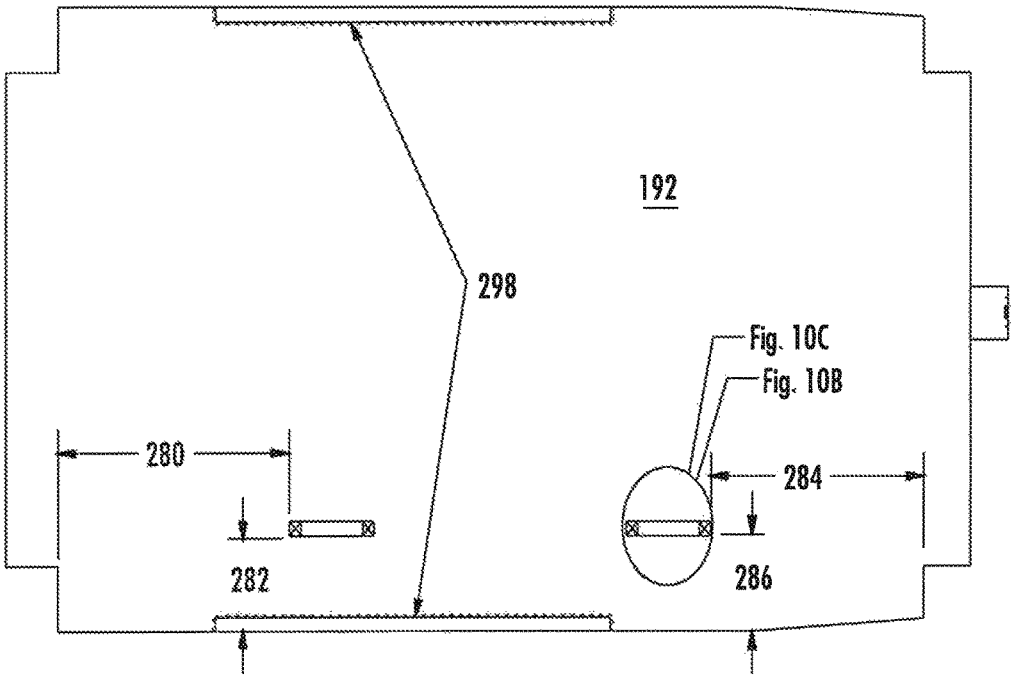
FIG. 10A is a plan elevational view of a bottom cover piece portion, similar to FIG. 9A hereof, of an exemplary embodiment of the present FIG. 7 exemplary cover in accordance with presently disclosed subject matter, and illustrating various preferred stitching features thereof, and with FIGS. 10B and 10C illustrating various enlarged views of certain features of such FIG. 10A illustration.
Figure 10B:
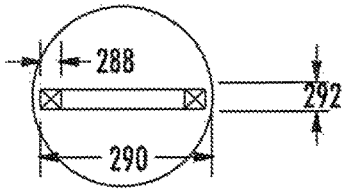
Figure 10C:
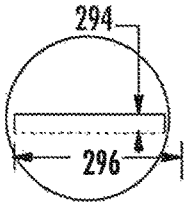

FIG. 7 is a generally top and side perspective view, separated, of top and bottom pieces collectively forming an exemplary cover in accordance with presently disclosed subject matter. FIG. 8 is a plan elevational view of a top cover piece portion of an exemplary embodiment of the present FIG. 7 exemplary cover. FIG. 9A is a plan elevational view of a bottom cover piece portion of an exemplary embodiment of the present FIG. 7 exemplary cover, and FIG. 9B is a side elevational view of the same. FIG. 10A is a plan elevational view of a bottom cover piece portion, similar to FIG. 9A hereof, of an exemplary embodiment of the present FIG. 7 exemplary cover, and illustrating various preferred stitching features thereof. Present FIGS. 10B and 10C illustrate various enlarged views of certain features of such FIG. 10A illustration.

FIG. 7 represents jersey knit or mesh features for venting from mattress 102, relative to top cover piece generally 190 and bottom cover piece generally 192. Zipper chain 194 and zipper pull 196 features are also represented by present FIG. 7. Additionally, feature 198 represent nylon webbing serving a handle function for mattress 102. Additional nylon webbing generally 200 serves as reinforcement. A customizable mattress label may be provided in various places, as represented in a particular location by feature 202.

The top cover material piece generally 190 as represented in present FIG. 8 may have various shaped portions and various dimensions for well functioning in its top cover role. While variations may be practiced, one exemplary set of dimensions are set forth as follows in Table 1, relative to the indicated dimensional features 204 through 236 of present FIG. 8:

TABLE 1 re FIG. 8

| Reference No. | Exemplary Dimensions (in inches) |
|---|---|
| 204 | 45.0 |
| 206 | 4.75 |
| 208 | 35.5 |
| 210 | 4.75 |
| 212 | 4.75 |
| 214 | 4.75 |
| 216 | 90.5 |
| 218 | 67.25 |
| 220 | 67.25 |
| 222 | 0.75 |
| 224 | 0.75 |
| 226 | 14.5 |
| 228 | 4.0 |
| 230 | 4.0 |
| 232 | 4.0 |
| 234 | 35.5 |
| 236 | 4.0 |

The bottom cover material piece generally 192 as represented in present FIG. 9A may have various shaped portions and various dimensions for well functioning in its bottom cover role. While variations may be practiced, one exemplary set of dimensions are set forth as follows in Table 2, relative to the indicated dimensional features 238 through 278 of present FIGS. 9A & 9B:

TABLE 2 re FIGS. 9A & B

| Reference No. | Exemplary Dimensions in inches |
|---|---|
| 238 | 4.75 |
| 240 | 35.5 |
| 242 | 4.75 |
| 244 | 4.75 |
| 246 | 14.0 |
| 248 | 14.0 |
| 250 | 37.0 |
| 252 | 1.0 |
| 254 | 1.0 |
| 256 | 37.0 |
| 258 | 38.0 |
| 260 | 16.25 |
| 262 | 16.25 |
| 264 | 14.5 |
| 266 | 14.5 |
| 268 | 4.0 |
| 270 | 4.0 |
| 272 | 1.5 |
| 274 | 4.0 |
| 276 | 35.5 |
| 278 | 4.0 |

The bottom cover material piece generally 192 as represented in present FIG. 10A may have various shaped stitching as well as various dimensions for well functioning in its bottom cover role. Stitching 298 represents the addition of stitched jersey mesh material to the bottom fabric generally 192, to create vent features in accordance with the presently disclosed subject matter. As understood by those of ordinary skill in the art from the complete disclosure herewith, air may pass in either direction relative to such vents (that is, either in to or out of mattress 102), over the course of operation of the presently disclosed subject matter. While variations may be practiced, one exemplary set of dimensions are set forth as follows in Table 3, relative to the indicated dimensional features 280 through 296 of present FIGS. 10A through 10C:

TABLE 3 re FIGS. 10A-C

| Reference No. | Exemplary Dimension (in inches) |
|---|---|
| 280 | 21.0 |
| 282 | 6.75 |
| 284 | 21.0 |
| 286 | 6.75 |
| 288 | 1.0 |
| 290 | 8.0 |
| 292 | 1.0 |
| 294 | 1.0 |
| 296 | 8.0 |

The enlarged illustration of present FIG. 10B particularly illustrates fabric outside detail for a formed handle (with the handle stitched in two places). Present FIG. 10C illustrates fabric inside handle detail, to illustrate preferred stitching reinforcement.

In various other embodiments, as referenced above, the presently disclosed subject matter may be integrated with other supports including various mattresses, wheelchair/seating cushions, and/or patient positioners (whether pre-existing, disclosed herewith, or later developed). Several exemplary such support surfaces can be found in commonly owned U.S. Pat. No. 5,568,660 to Raburn et al; U.S. Pat. No. 5,797,155 to Maier et al.; and U.S. Design Pat. No. D355,488 to Hargest et al., the disclosures of which are fully incorporated herein by reference, for all purposes.

While the presently disclosed subject matter has been described in detail with respect to specific embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the presently disclosed subject matter as would be readily apparent to one of ordinary skill in the art.

What is claimed is:

1. Methodology for providing a self-powered microclimate for the prevention and treatment of decubitus ulcers of a patient received on a support surface, comprising: providing a resilient patient support, having at least one integrated air cell, and forming a patient support surface; providing a three-dimensional spacer fabric area of support relative to at least a portion of the patient support surface; pneumatically interconnecting such three-dimensional spacer fabric area directly with the at least one integrated air cell so that an air passage is formed between the interior of the at least one integrated air cell and the three-dimensional spacer fabric area; supporting a patient on such patient support surface with at least a portion of the patient received adjacent the three-dimensional spacer fabric area of support, wherein at least one physical movement of said patient received on the patient support surface causes air to be expelled from the at least one integrated air cell via said pneumatic interconnection and at least one second physical movement of said patient received on the patient support surface causes air to be drawn into the at least one integrated air cell via said pneumatic interconnection, which in turn results in air movement relative to such three-dimensional spacer fabric area, resulting in cooling effects by removing moisture and/or heat from adjacent the patient; and providing a cover around said resilient patient support and said three-dimensional spacer fabric area of support with at least one vent through said cover for passage of air therethrough both expelled from said three-dimensional spacer fabric area of support and drawn therein dependent on the physical movement of the patient received on the patient support surface; wherein said at least one integrated air cell comprises a plurality of air cylinders oriented one of length-wise and laterally within said resilient patient support, with said air cylinders positioned to be manipulated by patient movement on said resilient patient support; and supporting said patient includes receiving part of a patient's back and buttocks adjacent said three-dimensional spacer fabric area of support.

2. Methodology as in claim 1, further including modularly integrating said patient support surface with one of a mattress, a wheelchair/seating cushion, a patient positioner, a mattress coverlet, and a consumer-oriented support.

3. Methodology as in claim 1, wherein:

providing said resilient patient support comprises providing a multi-piece foam shell including at least a foam shell topper, a foam header, and a foam footer; and said pneumatically interconnecting comprises interconnecting air tubing between said spacer fabric and said at least one integrated air cell.

4. Methodology as in claim 1, wherein said resilient patient support comprises a mattress which is at least partially made of foam.

5. Methodology as in claim 1, wherein:

said patient support surface is integrated into a mattress system;

said cover comprises moisture permeable material; and said three-dimensional spacer fabric area of support comprises a material less than about 1.0 inches thick.

6. Methodology as in claim 5, wherein said mattress system further includes an integrated sensor system for sensing at least one of temperature, moisture, and pressure of said mattress system.

7. Methodology as in claim 5, wherein said cover comprises a protective zippered sheath over said mattress system.

8. Methodology as in claim 1, wherein said patient support includes a foam topper having a plurality of surface cuts and channels forming a plurality of separate upright support elements, the size and construction of which are predetermined over the surface of said foam topper so as to provide selected support characteristics to a patient supported thereon.

9. Methodology as in claim 1, wherein said plurality of respective air cylinders each include respective resilient internal structures, so that with relatively less patient pressure on a given location of said air cylinders, expansion of such cylinders by their respective resilient internal structures causes air to be drawn back into such cylinders through said at least one vent, through the three-dimensional spacer fabric area of support through the pneumatic interconnection.

10. Methodology as in claim 1, wherein said plurality of respective air cylinders each have respective generally rectangular cross-sections.

11. Methodology as in claim 1, wherein said plurality of respective air cylinders respectively comprise cylinders integrally formed from woven nylon fabric fused to polymeric film.

12. Methodology as in claim 1, wherein said resilient patient support includes at least in part resilient support foam received between said air cylinders and a patient supported on said patient support.

13. Methodology for providing a self-actuated microclimate for the prevention and treatment of tissue damage of a patient received on a support surface, comprising: providing a resilient patient support, having at least one integrated air cell, and forming a patient support surface, with said at least one integrated air cell comprising a plurality of air cylinders oriented one of length-wise and laterally within said resilient patient support, with said air cylinders positioned to be manipulated by patient movement on said resilient patient support; providing a three-dimensional spacer fabric area of support relative to at least a portion of the patient support surface, with such three-dimensional spacer fabric area of support maintaining air flow capabilities in said area even while supporting a patient; supporting a patient on such patient support surface with a portion of the patient's back and buttocks received above the three-dimensional spacer fabric area of support, so that air movement capability is maintained relative to such three-dimensional spacer fabric area, to allow for the removal of moisture and/or heat from below a supported patient; and pneumatically interconnecting such three-dimensional spacer fabric area directly with the plurality of air cylinders, wherein at least one physical movement of said patient received on the patient support surface causes air to be expelled from the plurality of air cylinders via said pneumatic interconnection and at least one second physical movement of said patient received on the patient support surface causes air to be drawn into the plurality of air cylinders via said pneumatic interconnection so that an air passage is formed between the interiors of the plurality of air cylinders and said three-dimensional spacer fabric area which in turn results in air movement relative to such three-dimensional spacer fabric area, resulting in removing moisture and/or heat from beneath the patient; and further including at least partially venting said three-dimensional spacer fabric area of support to the surrounding environment, so that natural convection between the surrounding environment and air beneath a patient in said three-dimensional spacer fabric area of support results in removing moisture and/or heat from beneath the patient.

14. Methodology as in claim 13, wherein said resilient patient support comprises a mattress which is at least partially made of foam.

15. Methodology as in claim 13, further including modularly integrating said patient support surface with one of a mattress, a wheelchair/seating cushion, a patient positioner, a mattress coverlet, and a consumer-oriented support.

16. Methodology as in claim 13, wherein:

providing said resilient patient support comprises providing a multi-piece foam shell including at least a foam shell topper, a foam header, and a foam footer; and said pneumatically interconnecting comprises interconnecting air tubing between said three-dimensional spacer fabric area and said plurality of air cylinders.

17. Methodology as in claim 13, wherein said patient support includes a foam topper having a plurality of surface cuts and channels forming a plurality of separate upright support elements, the size and construction of which are predetermined over the surface of said foam topper so as to provide selected support characteristics to a patient supported thereon.

18. Methodology as in claim 13, wherein said resilient patient support includes at least in part resilient support foam received between said air cylinders and a patient supported on said patient support.

19. Methodology as in claim 13, further comprising providing a cover around said resilient patient support and said three-dimensional spacer fabric area of support with at least one vent through said cover for passage of air therethrough both expelled from said three-dimensional spacer fabric area of support and as drawn therein, or from natural convection.

20. Methodology as in claim 19, wherein:

said patient support surface is integrated into a mattress system;

said cover comprises a moisture permeable material; and said three-dimensional spacer fabric area of support comprises an air flow friendly material less than about 1.0 inches thick.

21. Methodology as in claim 20, wherein said mattress system further includes an integrated sensor system for sensing at least one of temperature, moisture, and pressure of said mattress system.

22. Methodology as in claim 20, wherein said cover comprises a protective zippered sheath over said mattress system.

23. Methodology as in claim 19, wherein said plurality of respective air cylinders each include respective resilient internal structures, so that with relatively less patient pressure on a given location of said air cylinders, expansion of such cylinders by their respective resilient internal structures causes air to be drawn back into such cylinders through said at least one vent, through the three-dimensional spacer fabric area of support through the pneumatic interconnection.

24. Methodology as in claim 19, wherein said plurality of respective air cylinders each have respective generally rectangular cross-sections.

* * * * *